US006437295B1

(12) United States Patent
Hogg et al.

(10) Patent No.: US 6,437,295 B1
(45) Date of Patent: Aug. 20, 2002

(54) LOTION HEATING SYSTEM

(76) Inventors: Jason A. Hogg, 1739 N. Arbogast Ave. #2B, Griffith, IN (US) 46319; Shirley A. Johnson, 54 W. 83rd St., Chicago, IL (US) 60620

( * ) Notice: Subject to any disclaimer, the term of this patent is extended or adjusted under 35 U.S.C. 154(b) by 0 days.

(21) Appl. No.: 09/637,671

(22) Filed: Aug. 14, 2000

(51) Int. Cl.[7] ..... H01R 4/24

(52) U.S. Cl. ..... 219/439; 219/432; 219/433; 219/429

(58) Field of Search ..... 219/227, 242, 219/386, 387, 429, 430, 432, 435, 439, 441, 442, 521, 533, 433; 392/443, 444, 447, 476, 477, 324; 165/64

(56) References Cited

U.S. PATENT DOCUMENTS 1,860,302 A * 5/1932 Thomas ..... 165/64
1,946,573 A * 2/1934 De Vries ..... 392/324
2,505,092 A * 4/1950 Brewer ..... 219/433
2,516,637 A * 7/1950 McCollum ..... 219/433
2,843,719 A * 7/1958 Smith et al. ..... 219/429
3,155,260 A * 11/1964 Widener ..... 219/386
3,231,716 A * 1/1966 Van Den Bosch ..... 219/433
3,596,056 A * 7/1971 Dillarstone ..... 392/477
3,752,155 A * 8/1973 Blinoff, Jr. et al. ..... 219/242
3,772,500 A 11/1973 Thibault ..... 219/430
3,798,415 A * 3/1974 Graham ..... 219/441
3,804,076 A * 4/1974 Fant et al. ..... 219/439
3,829,655 A * 8/1974 Thibault ..... 219/430
3,892,945 A * 7/1975 Lerner ..... 219/432
4,107,513 A * 8/1978 Ashford ..... 219/430
4,160,152 A * 7/1979 Wightman et al. ..... 219/433
4,253,013 A * 2/1981 Mabuchi ..... 219/435
4,629,866 A * 12/1986 Proctor ..... 219/439
5,057,671 A * 10/1991 Colson ..... 219/521
5,248,870 A * 9/1993 Redal ..... 219/521
5,773,795 A * 6/1998 Messmer ..... 219/441
5,856,653 A * 1/1999 Boudreaux ..... 219/439

* cited by examiner

*Primary Examiner*—Teresa Walberg
*Assistant Examiner*—Fadi H. Dahbour
(74) *Attorney, Agent, or Firm*—Goldstein Law Offices, PC.

(57) ABSTRACT

A lotion heating system including a container having an open upper end, a closed lower end, and a side wall disposed therebetween. The container is dimensioned for receiving the bottle of lotion therein through the open upper end. A quantity of water is disposed within the container. A heating plate is secured within the container to the closed lower end thereof. A control knob is rotatably coupled with the side wall of the container. The control knob is in communication with the heating plate.

5 Claims, 2 Drawing Sheets

LOTION HEATING SYSTEM

BACKGROUND OF THE INVENTION

The present invention relates to a lotion heating system and more particularly pertains to heating a bottle of lotion so a person does not have to apply cold lotion to their body.

The use of heating devices is known in the prior art. More specifically, heating devices heretofore devised and utilized for the purpose of providing heat to objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,544,701 to Elder discloses a jacked device capable of warming a shaving cream container using shower or bath water. U.S. Pat. No. 5,231,266 to Warren discloses a device for warming disposable towels. U.S. Pat. No. 4,088,751 to Kenkare discloses a self heating cosmetic.

While these devices fulfill their respective, particular objective and requirements, the aforementioned patents do not describe a lotion heating system for heating a bottle of lotion so a person does not have to apply cold lotion to their body.

In this respect, the lotion heating system according to the present invention substantially departs from the conventional concepts and designs of the prior art, and in doing so provides an apparatus primarily developed for the purpose of heating a bottle of lotion so a person does not have to apply cold lotion to their body.

Therefore, it can be appreciated that there exists a continuing need for a new and improved lotion heating system which can be used for heating a bottle of lotion so a person does not have to apply cold lotion to their body. In this regard, the present invention substantially fulfills this need.

SUMMARY OF THE INVENTION

In the view of the foregoing disadvantages inherent in the known types of heating devices now present in the prior art, the present invention provides an improved lotion heating system. As such, the general purpose of the present invention, which will be described subsequently in greater detail, is to provide a new and improved lotion heating system which has all the advantages of the prior art and none of the disadvantages.

To attain this, the present invention essentially comprises a container having an open upper end, a closed lower end, and a side wall disposed therebetween. The container is dimensioned for receiving the bottle of lotion therein through the open upper end. The closed lower end has a base member secured thereto. The base member has a generally frustoconical configuration defined by a narrow upper end and a wide lower end. The base member serves to stabilize the container in an upright orientation. A quantity of water is disposed within the container. A heating plate is secured within the container to the closed lower end thereof. A control knob is rotatably coupled with the side wall of the container. The control knob is in communication with the heating plate. The control knob has a series of power settings corresponding with the heating plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lotion heating system which has all the advantages of the prior art heating devices and none of the disadvantages.

It is another object of the present invention to provide a new and improved lotion heating system which may be easily and efficiently manufactured and marketed.

It is a further object of the present invention to provide a new and improved lotion heating system which is of durable and reliable construction.

An even further object of the present invention is to provide a new and improved lotion heating system which is susceptible of a low cost of manufacture with regard to both materials and labor, and which accordingly is then susceptible of low prices of sale to the consuming public, thereby making such a lotion heating system economically available to the buying public.

Even still another object of the present invention is to provide a new and improved lotion heating system for heating a bottle of lotion so a person does not have to apply cold lotion to their body.

Lastly, it is an object of the present invention to provide a new and improved lotion heating system including a container having an open upper end, a closed lower end, and a side wall disposed therebetween. The container is dimensioned for receiving the bottle of lotion therein through the open upper end. A quantity of water is disposed within the container. A heating plate is secured within the container to the closed lower end thereof. A control knob is rotatably coupled with the side wall of the container. The control knob is in communication with the heating plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
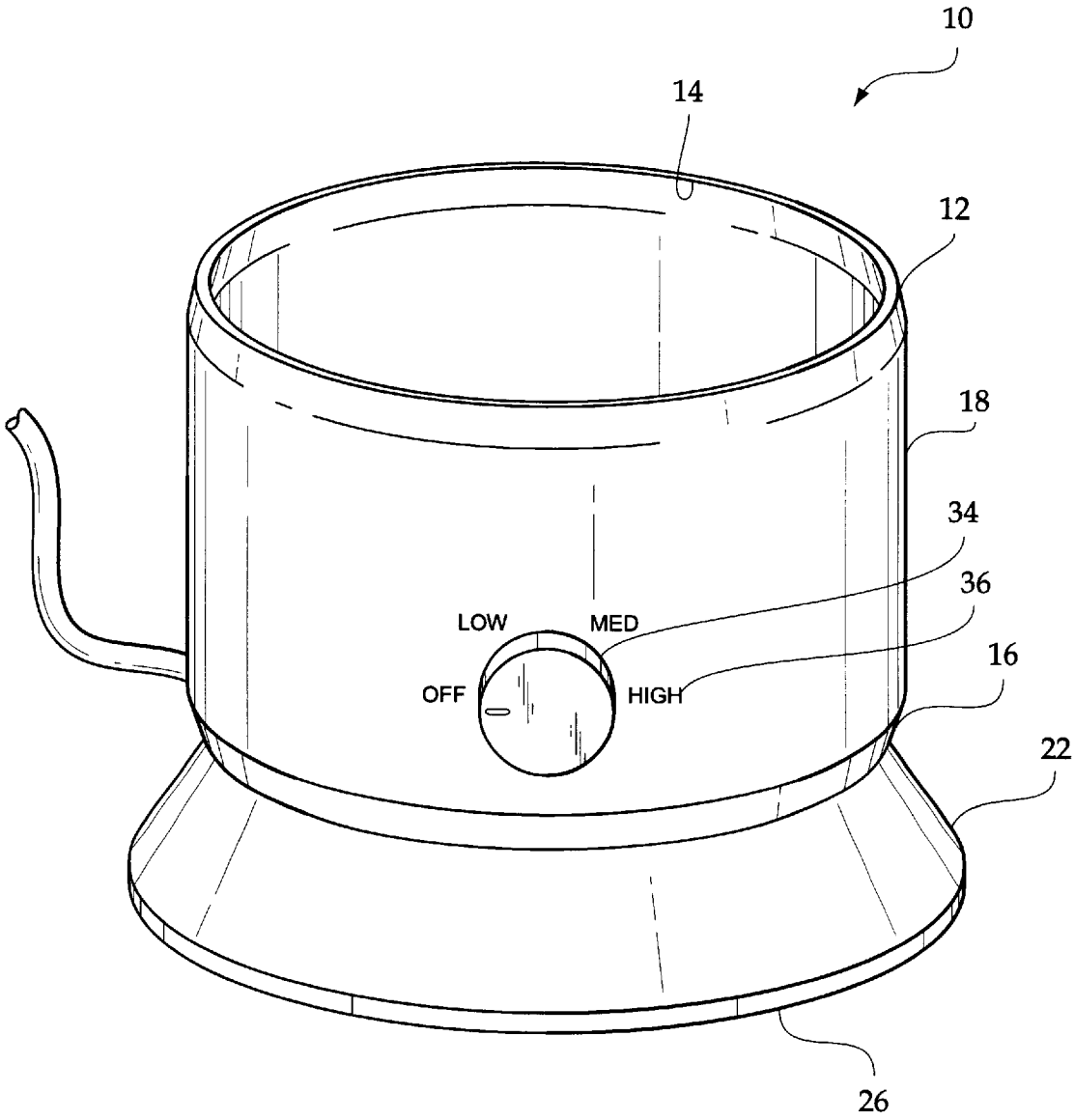
FIG. 1 is a perspective view of the preferred embodiment of the lotion heating system constructed in accordance with the principles of the present invention.
Figure 2:
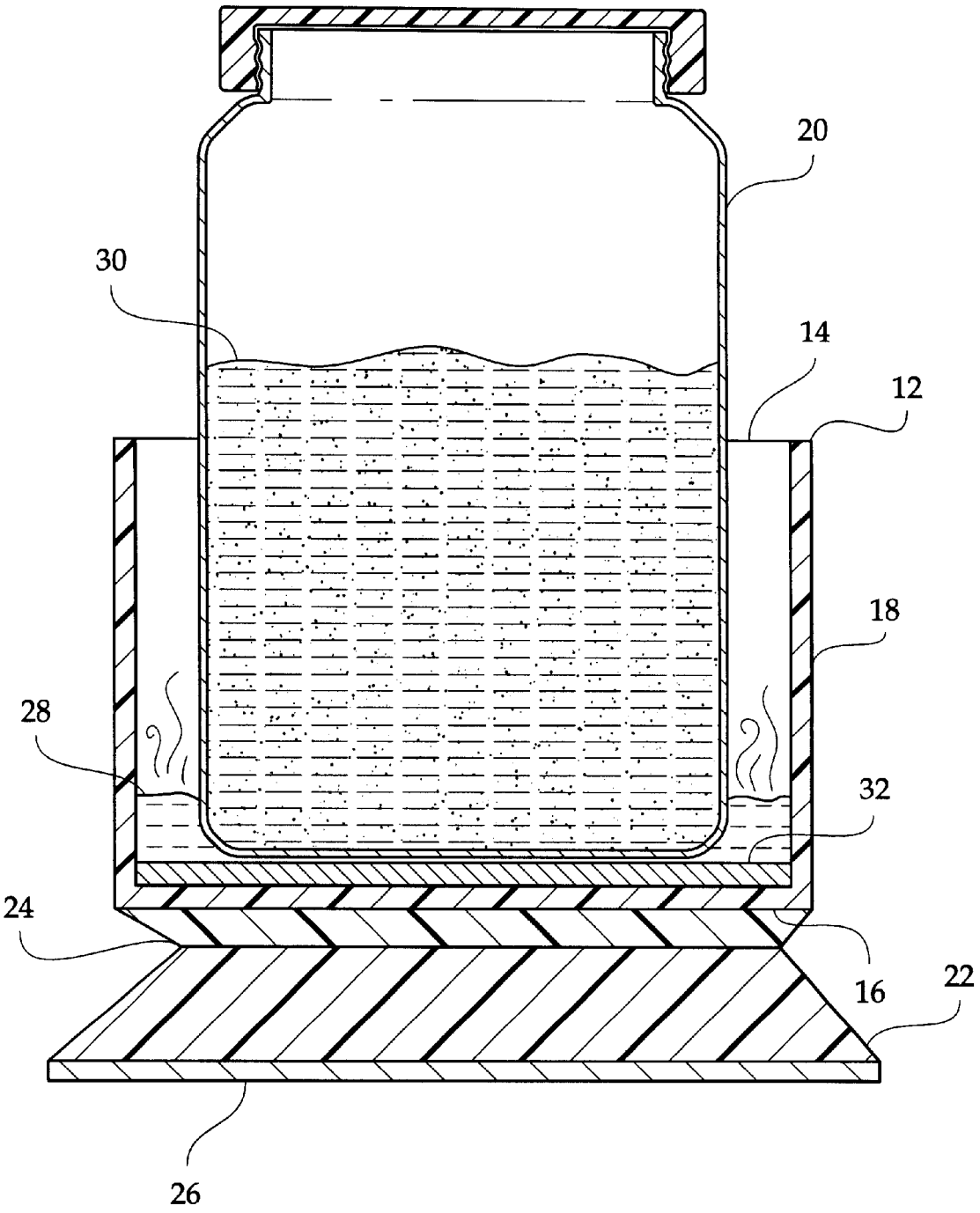
FIG. 2 is a cross-sectional side view of the present invention.

With reference now to the drawings, and in particular, to FIGS. 1 and 2 thereof, the preferred embodiment of the new and improved lotion heating system embodying the principles and concepts of the present invention and generally designated by the reference number 10 will be described.

Specifically, it will be noted in the various figures that the device relates to a lotion heating system for heating a bottle of lotion so a person does not have to apply cold lotion to their body. In its broadest context, the device consists of a container, a quantity of water, a heating plate, and a control knob. Such components are individually configured and correlated with respect to each other so as to attain the desired objective.

The container 12 has an open upper end 14, a closed lower end 16, and a side wall 18 disposed therebetween. The container 12 is dimensioned for receiving the bottle of lotion 20 therein through the open upper end 14. The closed lower end 16 has a base member 22 secured thereto. The base member 22 has a generally frustoconical configuration defined by a narrow upper end 24 and a wide lower end 26. The base member 22 serves to stabilize the container 12 in an upright orientation.

The quantity of water 28 is disposed within the container 12. The amount of water used will depend on the amount of lotion 30 that is in the bottle of lotion 20. More water will be needed when there is a significant amount of lotion 30 held in the bottle of lotion 20.

The heating plate 32 is secured within the container 12 to the closed lower end 16 thereof. The heating plate 32 will be powered by a power source, such as standard electrical power from an outlet or with batteries in a portable model.

The control knob 34 is rotatably coupled with the side wall 18 of the container 12. The control knob 34 is in communication with the heating plate 32. The control knob 34 has a series of power settings 36 corresponding with the heating plate 32. The power settings 36 allow the heating plate 32 to be heated with low heat, medium heat, or high heat. The control knob also includes an "off" setting to deactivate the heating plate 32.

The present invention is a device that warms lotions and oils to promote comfort and therapeutic benefits. It is an electric device that uses the quantity of water 28 as a conductor to warm the lotion 30 more effectively. The device 10 eliminates the discomfort associated with applying cold lotion products. The device 10 can be utilized by day spas, hospitals, rehabilitation facilities, premium hotels, and personal use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lotion heating system for heating a bottle of lotion so a person does not have to apply cold lotion to their body comprising, in combination:

a container having an open upper end, a closed lower end, and a side wall disposed therebetween, the container being dimensioned for receiving the bottle of lotion therein through the open upper end, the closed lower end having a base member secured thereto, the base member having a generally frustoconical configuration defined by a narrow upper end and a wide lower end, the base member serving to stabilize the container in an upright orientation;

a quantity of water disposed within the container;

a heating plate secured within the container to the closed lower end thereof; and a control knob rotatably coupled with the side wall of the container, the control knob being in communication with the heating plate, the control knob having a series of power settings corresponding with the heating plate.

2. A lotion heating system for heating a bottle of lotion so a person does not have to apply cold lotion to their body comprising, in combination:

a container having an open upper end, a closed lower end, and a side wall disposed therebetween, the container being dimensioned for receiving the bottle of lotion therein through the open upper end;

a quantity of water disposed within the container;

a heating plate secured within the container to the closed lower end thereof; and a control knob rotatably coupled with the side wall of the container, the control knob being in communication with the heating plate.

3. The lotion heating system as set forth in claim 2, wherein the closed lower end of the container has a base member secured thereto, the base member having a generally frustoconical configuration defined by a narrow upper end and a wide lower end, the base member serving to stabilize the container in an upright orientation.

4. The lotion heating system as set forth in claim 2, wherein the control knob has a series of power settings corresponding with the heating plate.

5. A lotion heating method for heating a bottle of lotion comprising, in combination:

providing a container having an open upper end, a closed lower end, and a side wall disposed therebetween, the container being dimensioned for receiving the bottle of lotion therein through the open upper end, the closed lower end having a base member secured thereto, the base member having a generally frustoconical configuration defined by a narrow upper end and a wide lower end, the base member serving to stabilize the container in an upright orientation;

providing a quantity of water within the container;

providing a heating plate secured within the container to the closed lower end thereof;

providing a control knob rotatably coupled with the side wall of the container, the control knob being in communication with the heating plate, the control knob having a series of power settings corresponding with the heating plate; and wherein the control knob is turned to one of the power settings to heat the heating plate, the heating plate will heat the quantity of water to heat the bottle of lotion.

* * * * *